US009048005B2

(12) United States Patent
Holloway

(10) Patent No.: US 9,048,005 B2
(45) Date of Patent: Jun. 2, 2015

(54) ELECTRIC POWER TRANSMISSION CABLE COMPRISING CONTINUOUSLY SYNTHESIZED TITANIUM ALUMINIDE INTERMETALLIC COMPOSITE WIRE

(75) Inventor: Scott Richard Holloway, Calgary (CA)

(73) Assignee: Lumiant Corporation, Calgary (CA)

( * ) Notice: Subject to any disclaimer, the term of this patent is extended or adjusted under 35 U.S.C. 154(b) by 806 days.

(21) Appl. No.: 13/352,143

(22) Filed: Jan. 17, 2012

(65) Prior Publication Data

US 2013/0180758 A1 Jul. 18, 2013

Related U.S. Application Data

(60) Provisional application No. 61/433,208, filed on Jan. 15, 2011.

(51) Int. Cl.
*H01B 1/02* (2006.01)

(52) U.S. Cl.
CPC ..... *H01B 1/023* (2013.01)

(58) Field of Classification Search
CPC ..... H01B 1/023; B22F 5/12
USPC ..... 174/DIG. 7
See application file for complete search history.

(56) References Cited

U.S. PATENT DOCUMENTS

| | | | |
|---|---|---|---|
| 3,297,415 | A | 1/1967 | Allen |
| 5,501,906 | A | 3/1996 | Deve |
| 6,051,277 | A | 4/2000 | Claussen et al. |
| 6,238,498 | B1 | 5/2001 | Ohriner et al. |
| 6,416,598 | B1 | 7/2002 | Sircar |
| 6,687,975 | B2 | 2/2004 | Tomsic |
| 2006/0018780 | A1 | 1/2006 | Hosamani et al. |
| 2006/0032558 | A1 | 2/2006 | Holloway |

FOREIGN PATENT DOCUMENTS

| | | | |
|---|---|---|---|
| WO | 0206549 | A1 | 1/2002 |
| WO | 2012108980 | A1 | 8/2012 |

OTHER PUBLICATIONS

International Preliminary Report on Patentability issued Jul. 16, 2013 in respect of International Application No. PCT/2012/021617.
Extended European Search Report issued Aug. 20, 2014 in respect of European Application No. 12744835.5.
Pan et al., Microstructural study of the interface reaction between titania whiskers and aluminum, Composites Science and Technology 57 319-325 (1997).
Peng et al., Evaluation of the microstructure of in-situ reaction processed Al3Ti—Al2O3—Al composite, Scripta Materiala 37 2 199-204 (1997).
Abdulhaqq et al., Processing, microstructure, and mechanical properties of cast in-situ Al(Mg,Ti)—Al2O3(TiO2) composite, Metallurgical and Materials Transactions A 37A 469-480 (2006).
International Search Report (PCT/US2012/021617), May 1, 2012.

*Primary Examiner* — Weiping Zhu
(74) *Attorney, Agent, or Firm* — Bereskin & Parr LLP/S.E.N.C.R.L., s.r.l.

(57) ABSTRACT

A method of manufacturing wire comprising aluminum oxide particles formed in situ in a fully dense matrix of titanium aluminide intermetallic material by means of the combustion synthesis of aluminum and titanium oxide followed by thermo-mechanical forming. The pre-combustion aluminum may be elemental, or an aluminum alloy containing one or more of the elements vanadium, niobium, molybdenum, or boron. The preferred embodiment of the present invention is an electric power transmission cable comprising a plurality of wires manufactured according to the present invention.

6 Claims, 8 Drawing Sheets

ELECTRIC POWER TRANSMISSION CABLE COMPRISING CONTINUOUSLY SYNTHESIZED TITANIUM ALUMINIDE INTERMETALLIC COMPOSITE WIRE

CROSS-REFERENCE TO RELATED APPLICATION

This application claims priority to U.S. Provisional Application No. 61/433,208 entitled "ELECTRIC POWER TRANSMISSION CABLE COMPRISING CONTINUOUSLY SYNTHESIZED TITANIUM ALUMINIDE INTERMETALLIC COMPOSITE WIRE," filed Jan. 15, 2011, the entire contents of which are hereby incorporated herein by reference.

BACKGROUND OF THE INVENTION

Titanium aluminide intermetallic matrix composite (TA-IMC) materials offer exceptional properties compared to conventional alloys and other composite materials. TA-IMC materials have low density (3.4-3.7 g/cc), high elastic modulus (170-210 GPa), high wear resistance, and operational temperatures as high as 900° C. Compared to conventional steel and aluminum alloys, TA-IMC materials offer greater specific strength and specific elastic modulus. Compared to conventional continuous fiber composites, such as ceramic fiber reinforced aluminum and carbon or glass fiber reinforced polymeric materials, TA-IMC materials offer substantially greater ductility and excellent transverse properties due to their isotropic nature. TA-IMC materials also offer a significantly higher operating temperature compared to these other conventional materials, and are not susceptible to the environmental problems associated with polymeric composites, such as corrosion, degradation and delamination as a result of exposure to moisture, heat and ultraviolet radiation.

An intermetallic is a metal alloy where the composition of at least two constituent metals is considered to be middle range, resulting in a solid phase crystalline material formed by an ordered structure of the two metal atom types. The most common titanium aluminide intermetallic solid phases are TiAl, $TiAl_3$, and $Ti_3Al$, with the preferred phase being TiAl due to its superior mechanical properties. Depending on the composition, a predominately TiAl intermetallic may also contain trace amounts of $TiAl_3$ and $Ti_3Al$. The TiAl intermetallic phase is often identified by the Greek letter γ (gamma). The phases where titanium is approximately 20-80% of the composition by weight are considered middle range, with compositions of 59-65% titanium by weight being most preferred. A titanium aluminide intermetallic composite material consists of a titanium aluminide intermetallic matrix, reinforced by some other material, usually a ceramic or metal oxide such as aluminum oxide ($Al_2O_3$, alumina). Reinforcement materials can be in the form of particles, short fibers or whiskers, or continuous fibers. Titanium aluminide intermetallic composite materials containing in situ formed alumina particles can be produced by the combustion reaction of aluminum (Al) and titanium dioxide ($TiO_2$, titania) to yield TiAl and alumina. The combustion synthesis reaction between aluminum and titania is known to be initiated at a temperature greater than 850° C.

Despite their numerous advantages, known TA-IMC materials suffer drawbacks that have hampered their use in many engineering applications. In fully dense form, the mechanical and physical properties of the bulk TA-IMC material are exceptional; however, due to crystal densification resulting from the transformation of aluminum and titania into titanium aluminide and alumina during the combustion synthesis reaction, a substantial amount of void content, or porosity, is created. The resulting void content has a significant adverse effect on the mechanical and physical properties of the TA-IMC material, rendering it unusable in this state for practical engineering applications. A known approach for eliminating porosity in combustion synthesized TA-IMC materials is to manufacture a ceramic preform containing titania particles combined with particles of an alkali metal titanate, such as lithium titanate of the chemical form $Li_2TiO_3$. The rigid and porous ceramic preform is then infiltrated with molten aluminum to form a pre-combustion material. During the subsequent combustion synthesis reaction which occurs spontaneously at a temperature well above the melting temperature of aluminum, the lithium titanate is chemically reduced by the molten aluminum to form lithium aluminate of the chemical form $LiAlO_2$. This process results in a volumetric expansion caused by the lower density of lithium aluminate compared to that of lithium titanate, which in turn counteracts the densification of the titanium aluminide to an extent sufficient to eliminate void formation during combustion synthesis. Alkali metals such as lithium are known however to be highly corrosive, and TA-IMC materials containing alkali metals cannot withstand high electrical voltage, high strain and high temperature conditions associated with electrical power transmission cables. Furthermore, the process of producing TA-IMC materials by means of a pre-combustion material comprising a rigid and porous ceramic preform is entirely unsuitable for the continuous manufacture of a wire.

While titanium aluminide intermetallic alloys are known, these materials are cost prohibitive with regards to producing a wire for electric power transmission cables due to the high cost of titanium metal and the metallurgical processes required to produce the alloy. In contrast, combustion synthesized TA-IMC materials are produced using a low energy, low cost process and utilize low cost raw materials in the form of aluminum metal and titania.

In view of the above, a need exists for fully-dense TA-IMC materials produced using a low cost process and low cost raw materials, but without the use of rigid ceramic preforms or alkali metal titanates, and which exhibit excellent mechanical and physical properties under high electric voltage, high strain and high temperature conditions. In particular, a need exists for a TA-IMC wire for electrical power transmission cables that are free from long term corrosion and degradation problems under loading conditions, and impervious to adverse environmental elements such as moisture and ultraviolet radiation.

The present invention pertains to a wire of combustion synthesized TA-IMC material. A preferred embodiment of the present invention pertains to the continuous combustion synthesis of TA-IMC from a pre-combustion feedstock material comprising elemental aluminum and titanium oxide (titania) followed by thermo-mechanical forming to eliminate the porosity inherently found in combustion synthesized TA-IMC material, and thereby forming a fully dense TA-IMC wire. The feedstock material, comprising elemental aluminum and titania particles, is itself in the form of a wire which may be produced by conventional means. The titania particles of the feedstock material may be of the chemical composition TiO, $TiO_2$, $Ti_2O_3$ or any combination thereof.

In the present invention the feedstock material is continuously fed into an enclosed chamber or reactor which contains a heating means to sufficiently heat a section of the continuously fed feedstock as to initiate the Ti—Al combustion synthesis reaction. The speed of the feeding mechanism is maintained such that the combustion front within the feedstock material remains enclosed within the confines of the reactor. Because the Ti—Al synthesis reaction is exothermic, additional heat need only be applied as necessary to continuously maintain the combustion reaction. The reactor chamber may contain an atmosphere of air or inert gas, or a vacuum may be applied around the feedstock wire at the point of combustion. As the combustion synthesized TA-IMC wire exits the reactor, additional heat may be applied as necessary to maintain a desired temperature optimal for thermo-mechanical forming.

Upon exiting the reactor chamber, the hot TA-IMC wire is drawn through one or more wire forming dies such that its diameter is sufficiently reduced as to eliminate void content, impart axial elongation of the Ti—Al grain structure and uniformly orient in situ formed alumina particles, thereby achieving the desired mechanical properties along the continuous length of the wire. At temperatures above 1150° C., the gamma ($\gamma$) phase titanium aluminide will partially transform into the alpha ($\alpha$) phase titanium aluminide, and possibly some metastable beta ($\beta$) phase titanium aluminide, both of which increase the hot-workability of the material. Furthermore, the relative abundance of $\alpha$ and $\beta$ phases present at the optimum thermo-mechanical processing temperature can be increased by adding various alloying elements to the pre-combustion feedstock such that in the post-combustion synthesized intermetallic alloy these elements are less than 5% by weight. These alloying elements include vanadium (V), niobium (Nb), molybdenum (Mo), and Boron (B). Finally, the present invention pertains to a plurality of said wires such as to form the reinforcing core of an assembled electric power transmission cable.

TA-IMC wires of the present invention are useful in numerous applications. Such wires are particularly desirable for use in electric power transmission cables due to their combination of low weight, high strength, high elastic modulus, good electrical conductivity, low coefficient of thermal expansion, high operating temperatures, resistance to corrosion and high ductility. The technical benefit and overall utility of TA-IMC wires of the present invention for use in electric power transmission cables, is a result of the significant effect cable performance has on the entire electricity generation, transmission and distribution system.

The design of an electric power transmission system consists primarily of power transmission cables and supporting structures. The load bearing capacity required of the supporting structure is determined by the density of the cables, the number of cables, and length, or span, of the cables. Specifically, the span is the linear distance between two adjacent structures connected by the cables. For a given electric power transmission system design of specified voltage and amperage, power transmission cables comprising TA-IMC wires have a lower density compared to conventional cables comprising a core of steel wires. Further, the lower thermal expansion of cables comprising TA-IMC wires compared to conventional cables comprising steel wires results in less cable sag at a given operating temperature. In the design of the supporting structures, lower density cables enable the use of lower load capacity structures, and the lower degree of sag enables the use of structures of lower height, both of which reduce the cost of structures, thereby providing great economic benefit to the overall electric power transmission system.

Electrical power transmission cables of the present invention, having higher strength per unit weight, combined with increased conductivity, lower thermal expansion and high ductility provide the ability to install longer cable spans than are possible with conventional steel or composite fiber cable, and cable supporting towers of lower height and lower mechanical load capacity are also possible. Further, the high ductility of TA-IMC wires according to the present invention enables the use of standard installation tools and splices, and avoids the catastrophic brittle failure of the reinforcing core which is known to occur with continuous fiber type composite material cables. Still further, the high electrical conductivity and low electrical resistivity of the TA-IMC wire of the present invention improves the electrical properties and performance of the conductor cable and serves to reduce electrical losses, thereby minimizing the need for additional electric power generation to compensate for such losses.

When compared to other low-density electric power transmission cables known to the art, primarily cables comprising a core of continuous fiber composite type wires, cables of the present invention comprising a TA-IMC wire core offer additional advantages. Primarily, continuous fiber composite type wires exhibit no ductility along the longitudinal direction of the wire and are therefore known to be susceptible to sudden, catastrophic failure. Unlike continuous fiber type composite materials, TA-IMC materials are generally isotropic and exhibit ductility and strength in all directions. The grain elongation of the TA-IMC materials that occurs during the thermo-mechanical wire drawing process of the present invention serves to maximize the strength of the material in the longitudinal direction of the wire. Because of the isotropic nature and high ductility of TA-IMC wires, electric power transmission cables comprising a core of such wires may be spliced and installed using the same standard tools as are used with cables comprising a core of steel wires.

From the foregoing disclosure and the following more detailed description of the preferred embodiment of the present invention it will be apparent to those skilled in the art that the present invention provides a significant advance in the technology of intermetallic composite wire and electric power transmission cable. Particularly significant in this regard is the potential the invention affords for providing light weight electric power transmission cables capable of operating at higher temperatures compared to conventional electric power transmission cables reinforced with steel wires due to the low density, high strength, high elastic modulus and low coefficient of thermal expansion of the TA-IMC wire. It will be further apparent to those skilled in the art that the present invention provides a significant advantage due to the high ductility, durability and the resistance to corrosion and environmental degradation of the wire compared to other composite materials. Additional features and advantages of various preferred embodiments will be better understood in view of the detailed description provided below.

BRIEF SUMMARY OF THE INVENTION

The present invention pertains to a method of manufacturing combustion-synthesized composite material of in situ formed aluminum oxide particles uniformly distributed within a fully dense titanium aluminide intermetallic matrix in the form of a wire. Wires manufactured according to the present invention offer significant advantages over conventional wires used in electric power transmission cables where high strength, high elastic modulus, ductility, high operating temperature, electrical conductivity and low thermal expansion, individually or in combinations thereof, are required.

DETAILED DESCRIPTION OF THE INVENTION

Figure 1:
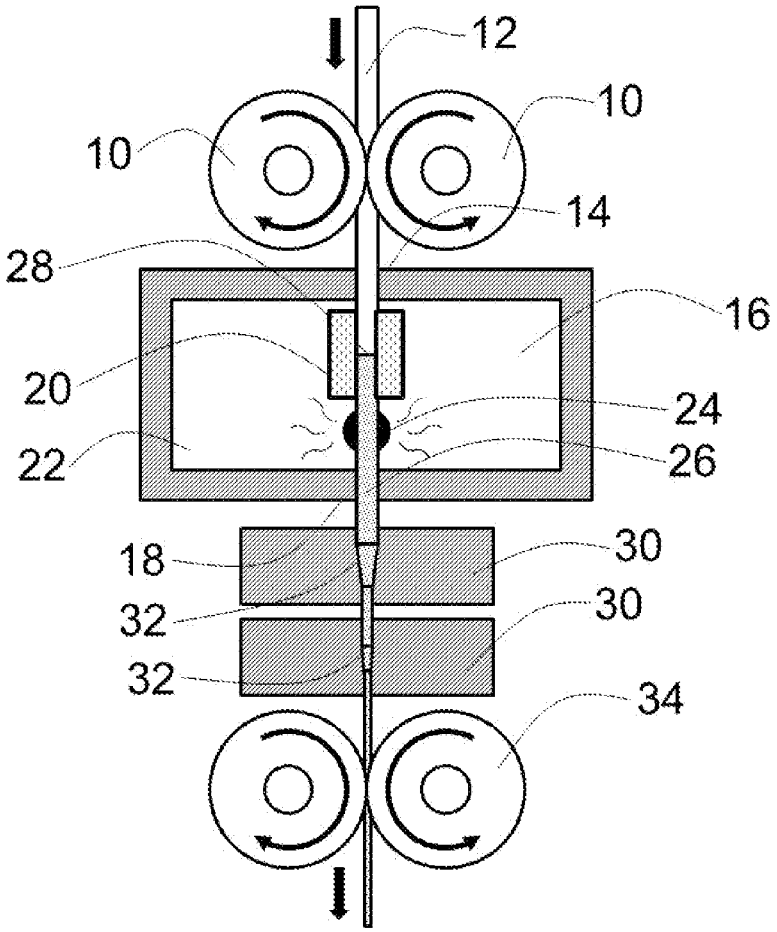
FIG. 1 shows an apparatus for continuously producing a wire comprising combustion synthesized titanium aluminide intermetallic matrix composite (TA-IMC) material.

The particle reinforced titanium aluminide intermetallic composite (TA-IMC) of the present invention comprises in situ formed particles of alumina ($Al_2O_3$) encapsulated in a matrix of predominantly γ-phase titanium aluminide intermetallic, synthesized by means of a thermally-initiated self-sustaining exothermic reaction taking place at a temperature above 850° C. between titania particles in the form of TiO, $TiO_2$ or $Ti_2O_3$, and aluminum, either in the form of unalloyed elemental aluminum, or an aluminum alloy containing one or more of the alloying elements vanadium (V), niobium (Nb), molybdenum (Mo), and boron (B), in such amount that the combined percent by weight of the aforementioned alloying elements constitutes less than 5% by weight of the pre-combustion mixture of titania and aluminum.

The TA-IMC wire of the present invention is produced by introducing a feedstock material formulated as described herein below into a combustion synthesis reactor, heating the feedstock to initiate a self-propagating exothermic chemical reaction thereby synthesizing TA-IMC from feedstock, engaging a first mechanical transport means to transport the feedstock into the combustion synthesis reactor at a rate such that the reaction boundary within the feedstock is maintained enclosed within the combustion synthesis reactor, applying additional heat by a second heating means as necessary to maintain the temperature of the synthesized TA-IMC to an optimal hot working temperature of at least 1150 degrees C. after it exits the combustion synthesis reactor, and engaging a second mechanical transport means to pull the combustion synthesized TA-IMC through a single or series of wire drawing dies, thereby reducing cross sectional diameter while at the same time compacting and elongating the grain structure to form a fully dense TA-IMC in the shape of a continuous wire.

The preferred embodiment of the present invention requires a pre-combustion feedstock produced by combining pure or alloyed aluminum with one or more forms of titania. Due to its low cost, the $TiO_2$ form of titania is preferred, and when combined with pure aluminum, the combustion synthesis of TA-IMC occurs according to the following reaction:

$$3TiO_2\{s\}+7Al\{l\}\rightarrow 3TiAl\{s\}+2Al_2O_3\{s\} \qquad \text{Equation (1)}$$

Where {l} indicates a liquid phase and {s} indicates a solid phase.

The reaction shown in Equation (1) is known to occur at a temperature of 850° C. According to the stoichiometry of the reaction, the volume fraction ($V_f$) of $TiO_2$ in the pre-combustion material needed to fully react all of the aluminum is 44.7%, based on a density of 4.23 g/cc for $TiO_2$, and a density of 2.70 g/cc for pure aluminum. Various methods may be used to produce the pre-combustion feedstock mixture of aluminum and titania, including infiltrating a porous titania preform with molten aluminum, mixing titania and aluminum powders and either compacting or extruding the mixture into feedstock having a desired shape, or by introducing titania particles directly into molten aluminum and continuously casting feedstock material in the form of a continuous shape, such as a cylinder, rod, or wire.

In accordance with Equation (1) alumina is also a product of the combustion synthesis reaction. It is desirable for the combustion synthesis reaction of Equation (1) to produce alumina in particulate form of uniform size that is uniformly distributed within the combustion synthesized TiAl material. Alumina particles smaller than 10 microns (μm) in diameter are advantageous with regards to the mechanical properties of the TiAl intermetallic composite, with particle diameters less than 1 μm preferred, and less than 50 nanometers (nm) most preferred. It has been discovered in the present invention that titania particle size and the manner of mixing titania particles with aluminum in preparing the feedstock material influences the particle size and size distribution of in situ formed alumina particles within the combustion synthesized TA-IMC matrix.

In the preferred embodiment of the present invention, it is desirable to minimize the amount of oxidized aluminum surface introduced into the feedstock mixture because such oxidation results in particles of alumina in the final TA-IMC of undesirable size (i.e., greater than 10 μm). Therefore, the preferred method of producing the pre-combustion feedstock material is to mix titania particles of a preferred size directly into molten aluminum. Titania particles smaller than 30 microns (μm) in diameter are advantageous, with particle diameters less than 3 μm preferred, and less than 0.3 μm most preferred. The melting temperature of pure aluminum is 660° C., therefore the molten aluminum should be at a temperature in the range of 660° C. to 850° C., with the preferred range being 680° C. to 780° C., and the most preferred range being 700° C. to 720° C. Within this temperature range, it is possible to mix the titania particles of preferred size into the molten aluminum without initiating the TA-IMC combustion reaction. Further, maintaining a temperature above the melting point of aluminum but below the initiation temperature of the TA-IMC combustion synthesis reaction enables a homogeneous and uniform dispersion of titania particles in molten aluminum, which, when continuously cast into the preferred form of a feedstock wire, results in a pre-combustion feedstock wire in which titania particles are uniformly distributed. Homogeneity and uniformity of titania particle distribution in the feedstock material results in solid phase $Al_2O_3$ particles of the desired size to be formed in situ during the combustion synthesis reaction.

Figure 4:
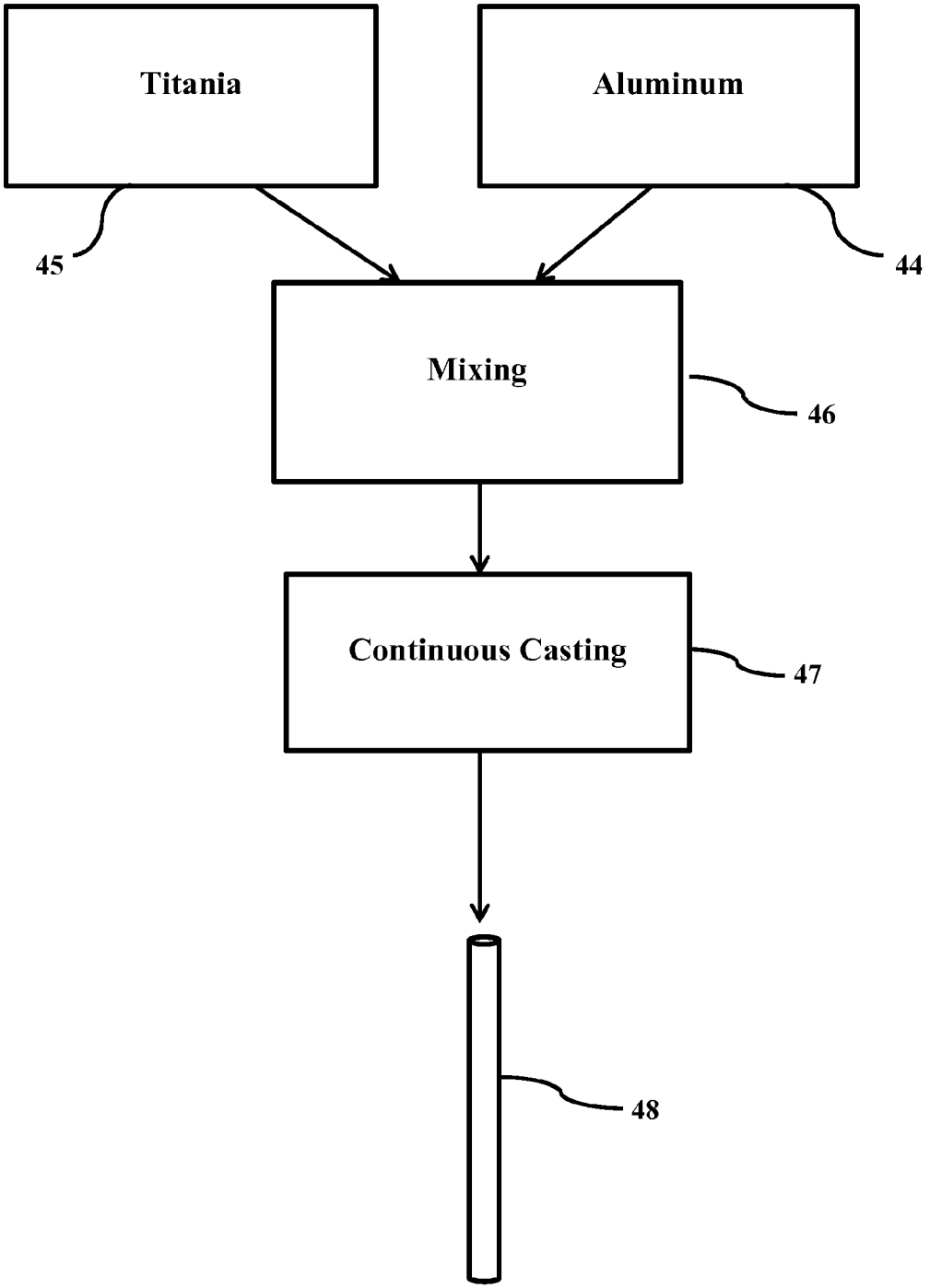
FIG. 4 shows the steps in preparation of feedstock material from titania and aluminum, comprising the steps of mixing titania with molten aluminum and continuously casting feedstock material.

FIG. 4 shows the preferred method of preparing feedstock material of the present invention, comprising the steps of heating aluminum above its melting point to a preferred temperature of 700° C. to 720° C. [44], introducing titania particles of the preferred size [45], mixing to ensure homogeneous distribution of titania particles [46] and continuous casting [47] to produce a feedstock material in the shape of a continuous cylinder or wire [48].

Figure 5:
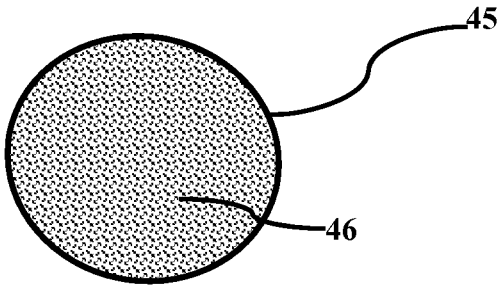
FIG. 5 shows a cross section of the feedstock material continuously cast in the form of a wire, illustrating the uniform distribution of titania particles therein.

FIG. 5 shows a cross-section of feedstock material [49] showing a uniform distribution of titania particles therein [50].

In the preferred embodiment of the present invention, alloying elements are added to the aluminum during or prior to preparing the pre-combustion feedstock, as it has been discovered that the hot-workability of the post-combustion synthesized TA-IMC at a temperature above 900 degrees C. is improved by the addition of certain alloying elements specified herein. Improvement of hot-workability is a result of a solid state phase transformation from gamma (γ) phase TiAl to alpha (α) and beta (β) phases. At the preferred temperature for thermo-mechanical processing of 1150° C., the gamma (γ) phase titanium aluminide transforms into the alpha (α) phase titanium aluminide, and some metastable beta (β) phase titanium aluminide, both of which α and β phases increase the hot-workability of the material. Further, the relative amounts of α and β phases present at the preferred thermo-mechanical processing temperature are increased by adding one or more alloying elements from the group vanadium (V), niobium (Nb), molybdenum (Mo), and boron (B) to the aluminum used in feedstock material such these elements are less than 5% by weight in the feedstock material.

In the preferred embodiment of the present invention shown in FIG. 1, the solid phase pre-combustion feedstock material containing titania, aluminum and any desired alloying elements 12 in the form of a continuous wire is introduced by means of a mechanical transport means 10 into an enclosed chamber or reactor, where the combustion synthesis reaction occurs according to Equation (1). In the preferred embodiment, the pre-combustion feedstock material 12 is fed vertically downward through an aperture in to the top of the reactor 14.

The reactor comprises an enclosed vessel having a central chamber 16 with upper 14 and lower 18 apertures located according to its central axis for introducing feedstock material 12 and withdrawing combustion synthesized TA-IMC 26. Contained within the reactor chamber 16 are a heating means 24 and an insulating means in the form of a centrally located hollow containment cylinder 20 for retaining heat generated by the exothermic combustion synthesis reaction. The heating means 24 serves to initiate and continuously maintain the combustion synthesis reaction as new feedstock material is fed into the reactor. The heat source may be of any conventional type, and in the preferred embodiment the heat source is capable of narrowly focusing thermal energy at a point on or within the feedstock material, such as electrical resistance heating elements, microwave transmitter, electron arc or plasma arc, or inductive means. The containment cylinder 20 comprises a non-reactive, high-temperature ceramic refractory material, such as alumina or zirconia, which is designed such that the internal diameter of the containment cylinder is similar in diameter to the external diameter of the feedstock material, thereby allowing the feedstock material to pass through the containment cylinder with minimum friction. The reactor includes an additional means for controlling the atmosphere within the reactor and is constructed such that the atmosphere within the reactor chamber can be atmospheric air or inert gas, or such that the reactor chamber can be evacuated 22. In the preferred embodiment, the chamber atmosphere is that of an inert gas, and most preferred gas is argon. The purpose of the inert gas atmosphere within the reactor chamber is to minimize the potential for contaminants from the ambient atmosphere being introduced into the TA-IMC material during the combustion synthesis reaction and, in particular, to prevent atmospheric oxygen from influencing particle size of alumina. While vertical orientation of the reactor is shown in the preferred embodiment of FIG. 1, the reactor orientation is not limited to any particular orientation.

With the feedstock material introduced into the reactor as shown in FIG. 1, a heat source 24 is applied to heat a discrete section of the stationary feedstock to a temperature above 850° C., thereby initiating the combustion synthesis reaction in accordance with Equation 1 to yield TA-IMC reaction product in the form of a continuous wire. As the combustion synthesis reaction front moves upward along the length of the vertically oriented feedstock material, a first transport means 10 is engaged such that new feedstock material is continuously introduced into the reactor at a rate equal to the combustion reaction front traveling through the feedstock such that the combustion reaction front maintains a stationary position within the reactor.

In the preferred embodiment shown in FIG. 1, thermo-mechanical processing is applied to the combustion synthesized TA-IMC after it exits the reactor in order to reduce its volume by 11% or more, eliminate porosity, and elongate the titanium aluminide intermetallic matrix grains, thereby resulting in a fully dense TA-IMC wire of high tensile strength. After the combustion synthesized TA-IMC material exits the reactor, it is heated to at least 1150 degrees C. by a second heating means, not shown, and while at this temperature is pulled by a second mechanical transport means 34 through either a single wire drawing die, or a series of wire drawing dies 30. Each wire drawing die 30 includes a conical shaped aperture 32 through which the TA-IMC materials are drawn. The minimum diameter of the aperture 32 must be smaller than the diameter of the TA-IMC wire being drawn through it, in order to constrain and reduce the cross-sectional area of the wire. In the preferred embodiment, a series of dies 30 are used with each consecutive die having incrementally smaller diameter aperture 32 so that the desired diameter of the TA-IMC wire can be achieved without exceeding the ultimate strength of the TA-IMC wire at the point of greatest material strain in the die. The diameter of the feedstock material is selected according to the desired final diameter of the wire, the removal of all void content, and the desired grain elongation. The minimum aperture diameter for each die and the number of dies in the series are determined as to cause plastic deformation of the TA-IMC material at its optimal hot working temperature, such that the amount of mechanical stress applied to the wire by each die is between the yield strength and the ultimate strength of the TA-IMC material.

Figure 2A:
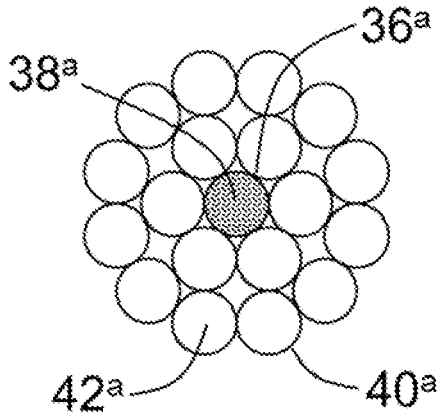
FIGS. 2*a*, 2*b*, 2*c* and 2*d* are cross-sectional views of embodiments of electric power transmission cables comprising reinforcing cores of one or more wires comprising TA-IMC material.
Figure 2B:
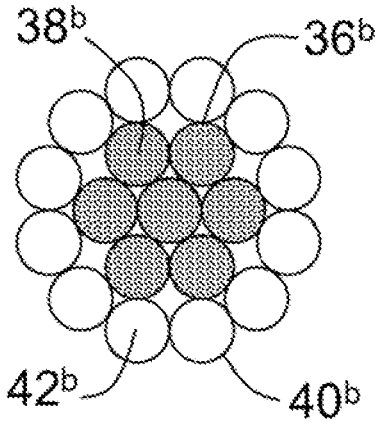
Figure 2C:
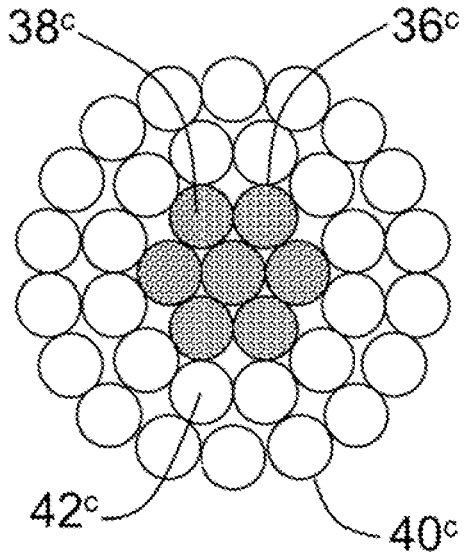
Figure 2D:
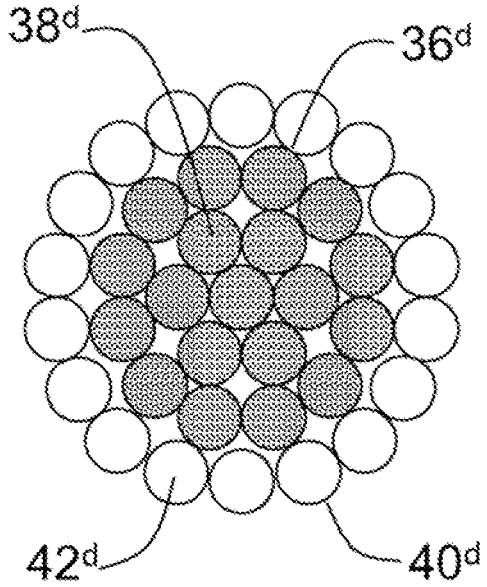
Figure 3:
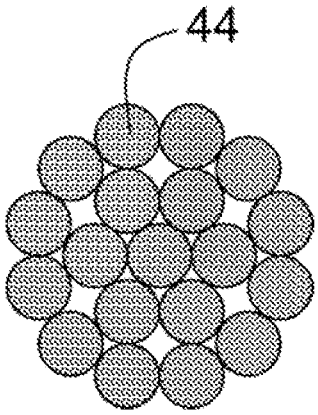
FIG. 3 is a cross-sectional view of an embodiment of an electric power transmission cable comprising a plurality of TA-IMC wires.

As described above, the TA-IMC wires of the present invention provide significant advantages when used in electric power transmission cables. In one embodiment, an electric power transmission cable includes an electrically conductive core formed by one or more TA-IMC wires of the present invention. The core is encased by a plurality of aluminum or aluminum alloy wires. Numerous cable core and encasement configurations are known in the cable art. For example, one embodiment of an electric power transmission cable, as illustrated by the cable cross-section shown in FIG. 2*a*, may be a core $\mathbf{36}^a$ of one TA-IMC wire $\mathbf{38}^a$, encased $\mathbf{40}^a$ by eighteen aluminum or aluminum alloy wires $\mathbf{42}^a$. An alternative embodiment of the present invention is illustrated by the electric power transmission cable cross-section shown in FIG. 2*b*, where the electric power transmission cable comprises a core $\mathbf{36}^b$ seven TA-IMC wires $\mathbf{38}^b$, encased by twelve aluminum or aluminum alloy wires $\mathbf{40}^b$. FIG. 2*c* shows a third embodiment of the present invention, illustrating one of a multitude of cable construction variations, comprising a core $\mathbf{36}^c$ of seven TA-IMC wires $\mathbf{38}^c$, encased $\mathbf{40}^c$ by thirty aluminum or aluminum alloy wires $\mathbf{42}^c$. Finally, FIG. 2*d* illustrates an electric power transmission cable comprising a core $\mathbf{36}^d$ of nineteen TA-IMC wires $\mathbf{38}^d$ encased $\mathbf{40}^d$ by eighteen aluminum or aluminum alloy wires $\mathbf{42}^d$. The weight percentage of TA-IMC wires relative to the entire cable will depend upon the overall electrical characteristics required by the design of the cable. The encasement wires of the cable may be any of the various materials known in the art of electric power transmission cables, including, but not limited to, 1350 Al alloy or 6201 Al alloy. In yet another embodiment of the present invention, as shown in FIG. 3, an electric power transmission cable comprising a plurality of TA-IMC wires 44 may be constructed.

I claim:

1. A method of manufacturing wire comprising in situ formed alumina particles in a fully dense combustion synthesized titanium aluminide matrix, the method comprising the steps of:

a. mixing titania particles with molten aluminum to form a feedstock material;

b. forming the feedstock material into a solid shape in the form of a continuous wire;

c. introducing the feedstock material through a first opening into an atmospherically controlled, thermally insulated enclosed chamber;

d. applying heat to the feedstock material in the chamber in an amount sufficient to initiate and maintain a titanium aluminide combustion synthesis reaction thereby producing a combustion synthesized titanium aluminide reaction product in the form of a continuous wire;

e. applying heat externally to the chamber such that the combustion synthesized titanium aluminide wire is heated to at least 1150 degrees C. after it exits the chamber through a second opening;

f. passing the heated combustion synthesized titanium aluminide wire through one or more wire drawing dies; and g. controlling a relationship between speeds of the feedstock material being introduced and the combustion synthesized titanium aluminide wire being passed through the dies such that a reaction front of the combustion synthesis reaction is maintained within the chamber and sufficient force is applied to the combustion synthesized titanium aluminide wire to reduce its cross section to a desired diameter by passage through the dies.

2. The method of claim 1 wherein titania particles in the form $TiO_2$ having a diameter of less than 30 microns are mixed with molten aluminum at a temperature of 700 to 720 degrees C. to create the feedstock material of step (a).

3. The method of claim 1 wherein the feedstock material of step (a) comprises 44.1 to 44.6 percent by weight aluminum and 55.4 to 55.9 percent by weight $TiO_2$.

4. The method of claim 1 wherein the feedstock material of step (a) comprises 41.1 to 41.6 percent by weight aluminum, 53.4 to 53.9 percent by weight $TiO_2$ and one or more elements from the group vanadium, niobium, molybdenum and boron at a concentration of 4.5 to 5.0 percent by weight.

5. The method of claim 1 wherein the atmosphere within the chamber of step (c) is argon.

6. A method of manufacturing wire comprising in situ formed alumina particles in a fully dense combustion synthesized titanium aluminide matrix, the method comprising the steps of:

a. mixing 53.4 to 53.9 percent by weight $TiO_2$ particles having a diameter less than 30 microns, 41.1 to 41.6 percent by weight aluminum at a temperature of 700 to 720 degrees C. and one or more elements from the group vanadium, niobium, molybdenum and boron at a concentration of 4.5 to 5.0 percent by weight to form a feedstock material;

b. forming the feedstock material into a solid shape in the form of a continuous wire;

c. introducing the feedstock material through a first opening into a thermally insulated enclosed chamber containing an atmosphere of argon;

d. applying heat to the feedstock material in the chamber to achieve and maintain a temperature of at least 850 degrees C. to initiate and maintain a titanium aluminide combustion synthesis reaction whereby a combustion synthesized titanium aluminide reaction product is produced in the form of a continuous wire;

e. applying heat externally to the chamber such that said combustion synthesized titanium aluminide wire is maintained at a temperature of at least 1150 degrees C. after it exits the chamber through a second opening;

f. passing the heated combustion synthesized titanium aluminide wire through one or more wire drawing dies; and g. controlling a relationship between speeds of the feedstock material being introduced and the combustion synthesized titanium aluminide wire being passed through the dies such that a reaction front of the combustion synthesis reaction is maintained within the chamber and sufficient force is applied to the combustion synthesized titanium aluminide wire to reduce its cross section by at least 11 percent to a desired diameter by passage through the dies.

* * * * *